US007971305B1

(12) United States Patent
Hubbard et al.

(10) Patent No.: US 7,971,305 B1
(45) **Date of Patent: *Jul. 5, 2011**

(54) METHODS AND APPARATUS FOR CLEANING SURFACES

(76) Inventors: Devin M. Hubbard, Gilbert, AZ (US); David E. Stafford, Jr., Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/787,525

(22) Filed: May 26, 2010

Related U.S. Application Data

(63) Continuation of application No. 11/179,150, filed on Jul. 12, 2005, now Pat. No. 7,735,178.

(51) Int. Cl.
*A47L 25/00* (2006.01)
*A47L 25/08* (2006.01)

(52) U.S. Cl. ..... 15/104.002; 15/105; 362/109

(58) Field of Classification Search ..... 15/104.002, 15/105; 362/109
See application file for complete search history.

(56) References Cited

U.S. PATENT DOCUMENTS

| | | | | |
|---|---|---|---|---|
| 2,681,467 | A | 6/1954 | Guyer | |
| 5,425,197 | A * | 6/1995 | Smith | 43/113 |
| 5,924,157 | A | 7/1999 | Barela | |
| 5,983,443 | A | 11/1999 | Redding | |
| 6,735,806 | B2 | 5/2004 | Blum et al. | |
| 6,763,977 | B2 | 7/2004 | McKay | |
| 6,871,443 | B2 | 3/2005 | Lambert et al. | |
| 2002/0170140 | A1 | 11/2002 | Diaz et al. | |

FOREIGN PATENT DOCUMENTS

| | | | |
|---|---|---|---|
| JP | 5-168386 | * | 7/1993 |
| JP | 09-253595 | | 9/1997 |
| JP | 10-218470 | | 8/1998 |

* cited by examiner

*Primary Examiner* — Randall Chin
(74) *Attorney, Agent, or Firm* — Parsons & Goltry; Michael W. Goltry; Robert A. Parsons

(57) ABSTRACT

Methods and apparatus for cleaning according to various aspects of the present invention include a cleaner and a lighting system. The cleaner, such as a handheld cleaner like a brush or lint roller, cleans the item or area to be cleaned. The lighting system illuminates the area or item to be cleaned. In one embodiment, the lighting system generates ultraviolet light to illuminate debris having phosphor materials.

7 Claims, 4 Drawing Sheets

METHODS AND APPARATUS FOR CLEANING SURFACES

This application is a continuation of U.S. application Ser. No. 11/179,150, filed 12 Jul. 2005, now U.S. Pat. No. 7,735,178.

BACKGROUND OF THE INVENTION

A large number of devices have been produced and marketed for cleaning items and surfaces. Most devices focus on the mechanism for removing the contaminants from the item or surface. Consequently, cleaning products include a vast array of solvents, cleaning agents, and systems for removing specific types of contaminants from nearly everything.

Identifying and locating contaminants and debris, however, is often difficult, especially in everyday applications that do not lend themselves to a specialized environment. For example, conventional cleaning systems such as brooms, mops, sweepers, and the like do not include any mechanism for locating and/or identifying dirt, debris, and other contaminants. Handheld cleaners, such as brushes and lint rollers, are similarly ill-equipped.

SUMMARY OF THE INVENTION

Methods and apparatus for cleaning according to various aspects of the present invention include a cleaner and a lighting system. The cleaner, such as a handheld cleaner like a brush or lint roller, cleans the item or area to be cleaned. The lighting system illuminates the area or item to be cleaned. In one embodiment, the lighting system generates ultraviolet light to illuminate debris having phosphor materials.

BRIEF DESCRIPTION OF THE DRAWINGS

A more complete understanding of the present invention may be derived by referring to the detailed description when considered in connection with the following illustrative figures. In the following figures, like reference numbers refer to similar elements and steps.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention is described partly in terms of functional components and various processing steps. Such functional components may be realized by any number of components configured to perform the specified functions and achieve the various results. For example, the present invention may employ various elements, materials, cleaners, adhesives, light emitters, frame configurations, and the like, which may carry out a variety of functions. In addition, the present invention may be practiced in conjunction with any number of applications, environments, and surfaces, and the systems described are merely exemplary applications for the invention. Further, the present invention may employ any number of conventional techniques for manufacturing, assembling, mounting, and the like.

Figure 1:
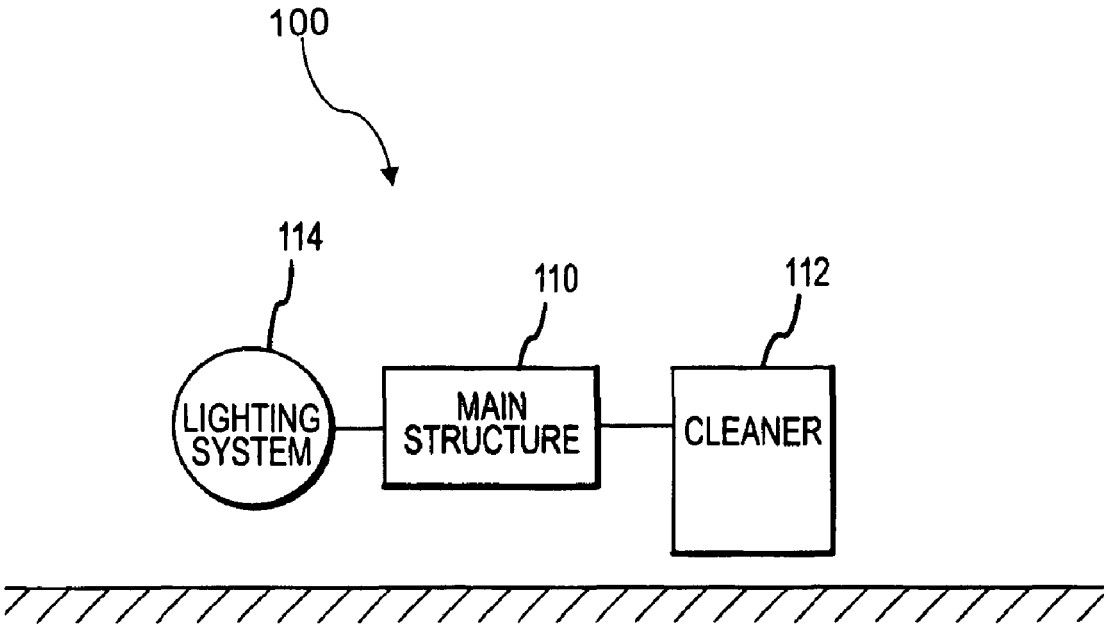
FIG. 1 is a block diagram of a cleaning system according to various aspects of the present invention.

Referring now to FIG. 1, a cleaning system 100 according to various aspects of the present invention comprises a cleaner 112 and a lighting system 114. A main structure 110 supports the components and systems for operating the cleaning system 100, and the cleaner 112 performs the cleaning. The lighting system 114 illuminates the area or item to be cleaned and/or materials to be removed from the item.

Figure 2:
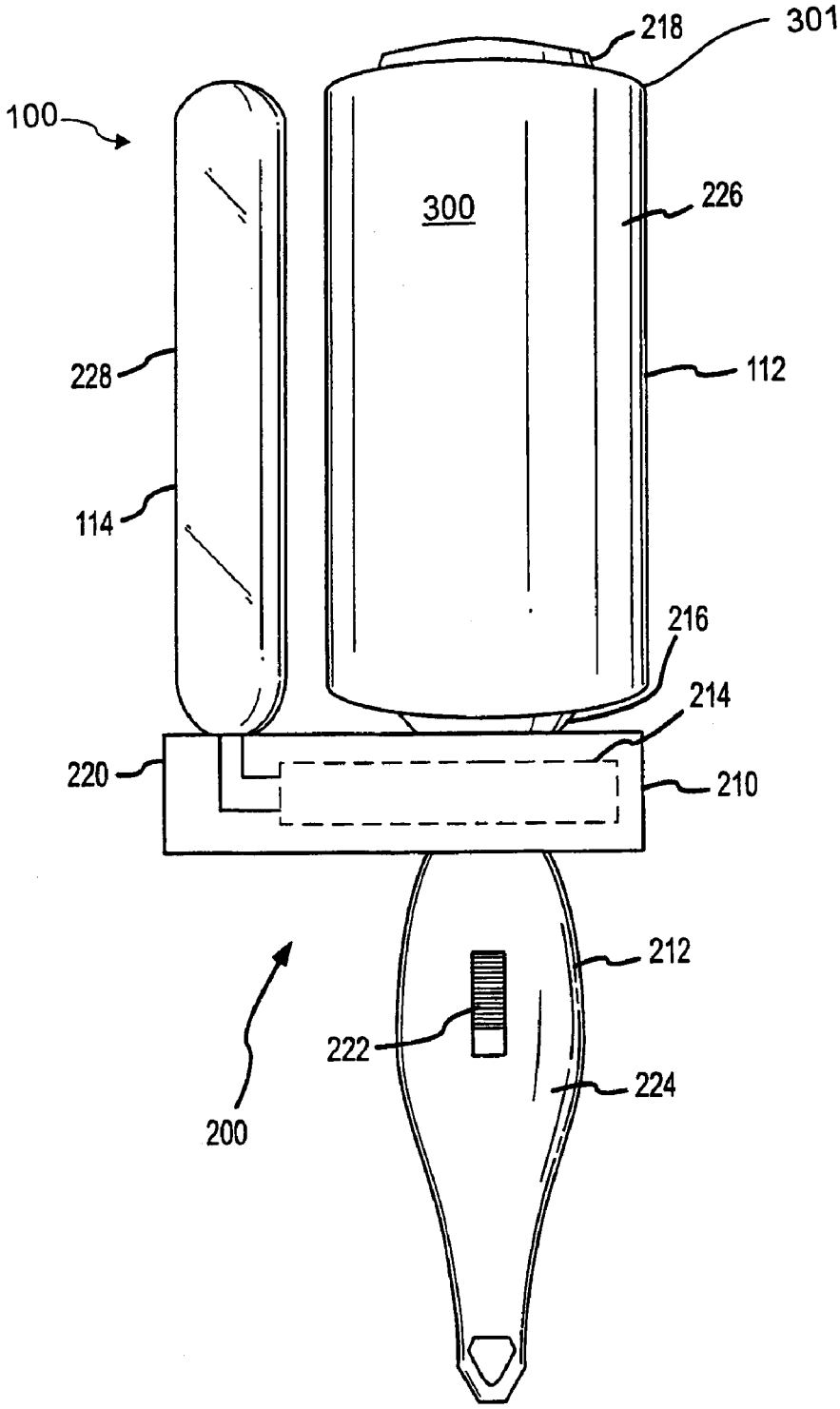
FIG. 2 is a bottom view of an exemplary cleaning system using a lint roller and an ultraviolet light source.

For example, referring now to FIG. 2, the cleaning system 100 may be implemented as a handheld particle remover 200. In the present embodiment, the main structure 110 comprises a handheld frame 210 configured to support other elements of the cleaning system 100, such as the lighting system 114 and the cleaner 112. The main structure 110 may, however, perform any suitable functions and be configured in any suitable manner.

In the present embodiment, the lighting system 114 and the cleaner 112 are mounted on the frame 210, and the frame suitably supports various other elements of the cleaning system 100. In particular, the frame 210 provides an operator interface 212 and a power supply 214. The operator interface 212 may comprise any appropriate interface, such as an attachment point for connecting to a tool or handle and/or one or more switches for activating various components of the system, and the power supply 214 provides power for one or more components of the cleaning system 100, such as the lighting system 114 or a motor for the cleaner 112.

The frame 210 may comprise any suitable system for supporting the various elements of the cleaning system 100. In the present embodiment, the frame comprises a substantially rigid body configured to support the cleaner 112 and the lighting system 114. For example, the frame 210 may comprise a metal, ceramic, or plastic element having two prongs which receive and retain the cleaner 112 in position. In an alternative embodiment, referring again to FIG. 2, the frame 210 may include a rod 216 for supporting the cleaner 112 and an end cap 218 to retain the cleaner 112 on the rod 216. The frame 210 may, however, use any appropriate mechanism for retaining the cleaner 112 in position.

The frame 210 may also support the lighting system 114. The frame 210 may support the lighting system 114 in any suitable manner, such as within a recess formed in the frame 210 supporting the length of the lighting system 114 or a base 220 supporting a portion of the lighting system 114. The frame 210 suitably supports the lighting system 114 such that the lighting system 114 illuminates a cleaning path of the cleaner 112. Any suitable configuration or mechanism may be used to support the lighting system 114 with respect to the cleaner 112.

The operator interface 212 may comprise any suitable elements to allow an operator to use the cleaning system 100. For example, in the present embodiment, the operator interface 212 includes a mechanism for controlling the lighting system 114, such as a switch 222 for selectively connecting the power supply to the lighting system 114. The switch 222 may be manually operated, or may respond to other input, such as sensing pressure applied to the cleaner 112. The operator interface 212 also suitably includes a mechanism for moving the cleaning system 100 across a surface to be cleaned, such as a handle 224 or an attachment mechanism for manipulating the cleaning system 100.

Figure 3:
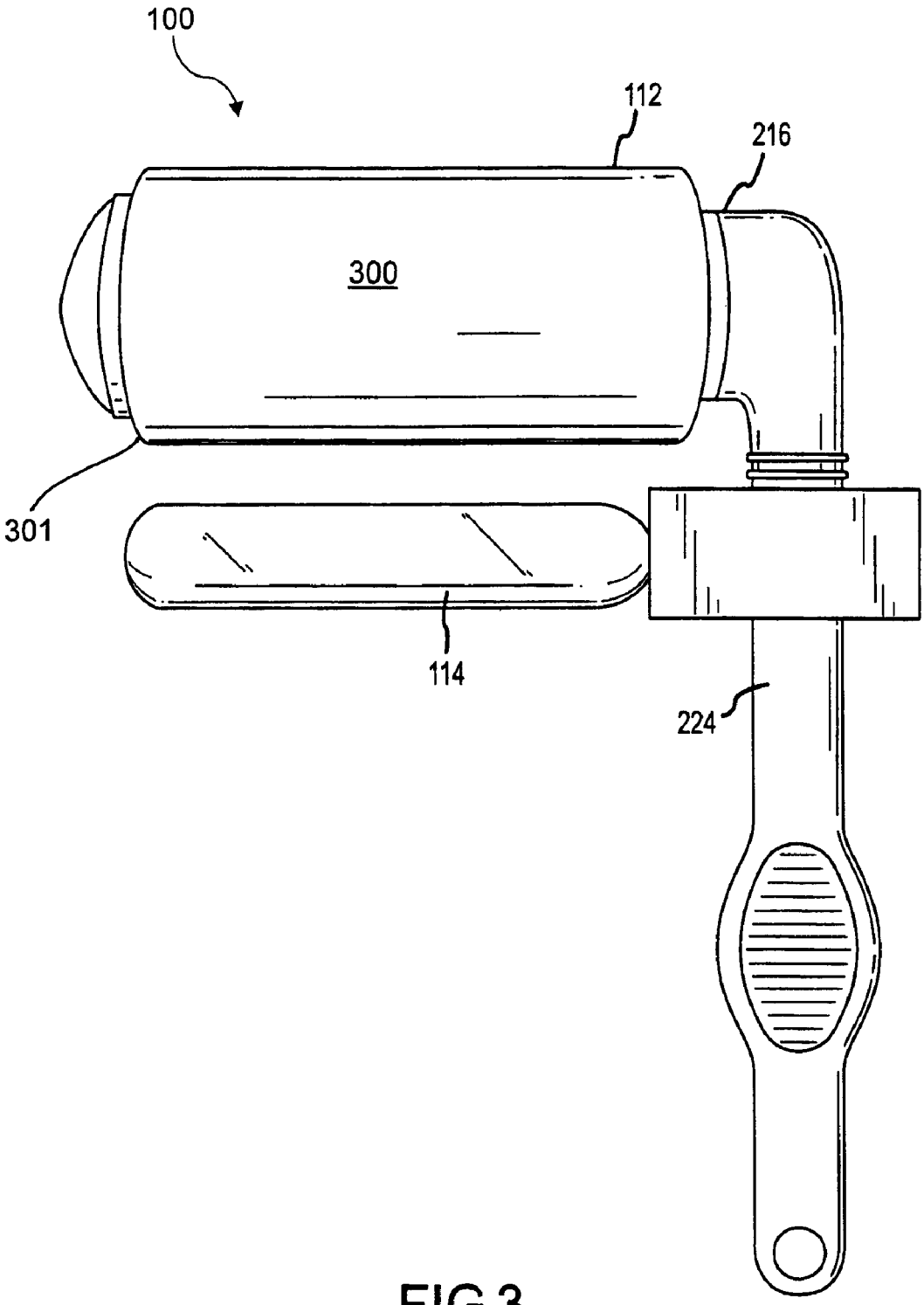
FIG. 3 is a bottom view of an alternative exemplary cleaning system using a lint roller and a lighting system having two light elements.

In the present embodiment, the frame 210 includes the handle 224 for manually moving the cleaning system 100 across the surface to be cleaned. The handle 224 may be configured in any suitable manner to operate the cleaning system 100. For example, in the present embodiment, the handle 224 extends substantially along the same axis as the rod 216. Referring to FIG. 3, in an alternative embodiment, the handle 224 may be disposed at an angle to the rod 216 axis The power supply 214 provides power to the cleaning system 100. The power supply 214 may provide power to any elements or components of the cleaning system 100. In the present embodiment, the power supply 214 provides power to the lighting system 114. The power supply 214 may comprise any suitable system, such as a battery, a power cord with a connection to an outlet or other power source, a generator powered by the movement of the cleaner 112 along a surface, or the like.

Figure 4:
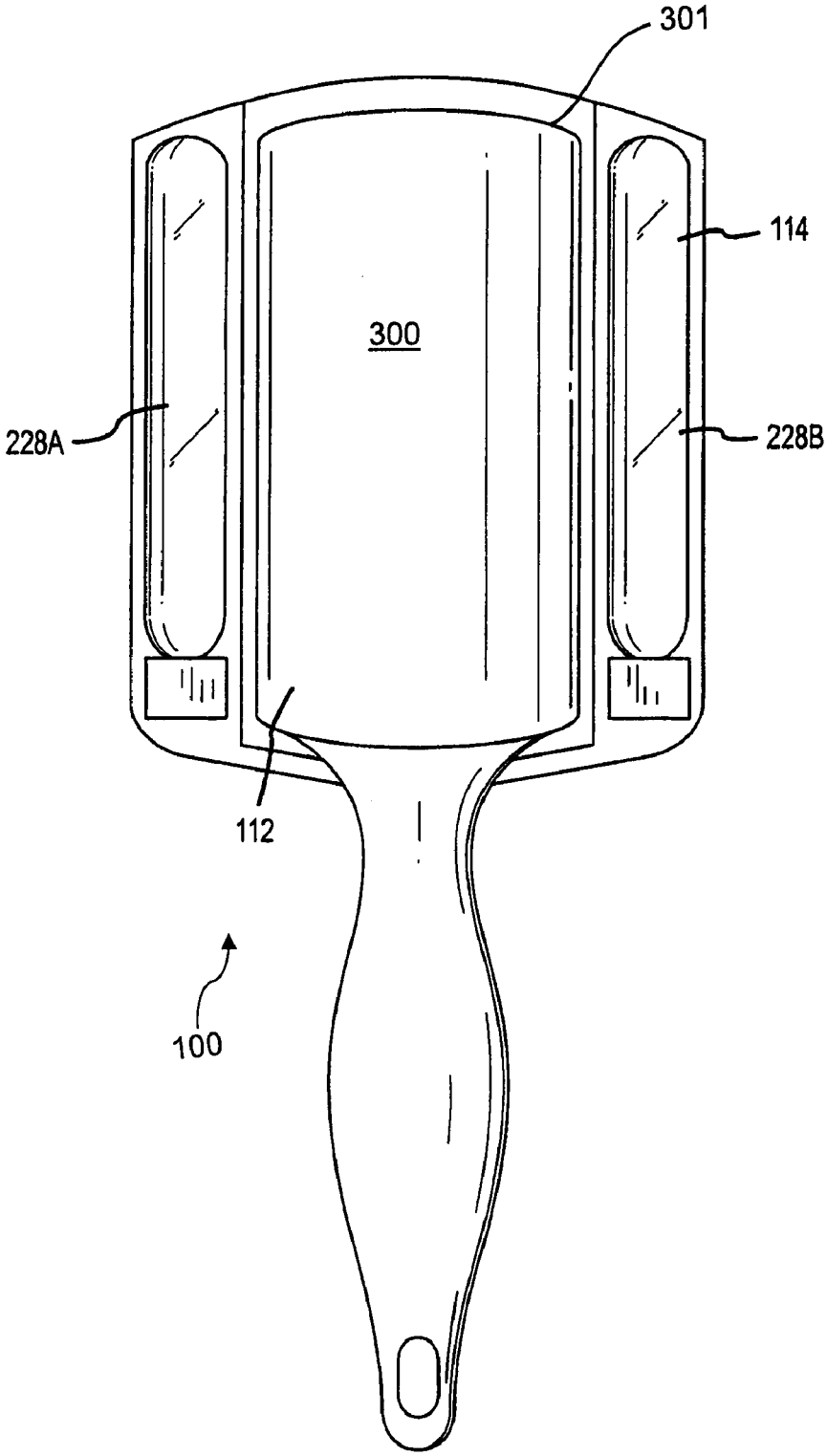
FIG. 4 is a bottom view of an alternative exemplary cleaning system using a handle that is not parallel to a rod supporting a lint roller.

The cleaner 112, which is shown in the various embodiments set forth in FIGS. 2-4, cleans objects, surfaces, fluids, and the like. The cleaner 112 may comprise any appropriate cleaner, such as a vacuum system, sweeper, brush, or other cleaner. In the present embodiment, the cleaner comprises an adhesive cleaner, such as a roller consisting of an exposed head 300 having an exposed adhesive exterior 301 like a conventional handheld lint roller 226. Because exposed head 300, having exposed adhesive exterior 301, is exemplary of a lint roller 226, head 300 may also be referred to as a lint head. The lint roller 226 is rotatably mounted on the rod 216 so that the lint roller 226 may be rolled along a surface. The lint roller 226 is also suitably removable from the rod 216 for replacement or reconditioning.

The lighting system 114 provides light to illuminate the area to be cleaned or material to be removed by the cleaner 112. The lighting system 114 may comprise any suitable system for providing light, such as an incandescent bulb, a fluorescent light, a light emitting diode, or other suitable light or array of such light sources. The lighting system 114 may be selected to particularly illuminate materials to be removed. In the present lint roller embodiment, the light system 114 includes an ultraviolet light, which tends to illuminate any particles including phosphors against the background of a fabric to be cleaned. In various embodiments, the lighting system 114 may be configured to generate only visible light, only ultraviolet light, both visible light and ultraviolet light, or any other suitable types of radiation.

The lighting system 114 may comprise any number or configuration of lights. For example, the lighting system 114 may comprise one light element 228, such as a bulb or diode or the like disposed proximate to the cleaner 112, such as adjacent the cleaner 112, for illuminating a path in front of the cleaner 112. Alternatively, referring to FIG. 4, the lighting system 114 may include two light elements 228A-B, such as on substantially opposite sides of head 300 of cleaner 112, to illuminate the path of the cleaner 112 both in front and to the rear. In another alternative embodiment, the lighting system 114 includes a U-shaped light element extending around the cleaner 112 to illuminate a greater area around the cleaning system 100. Any other number or configuration of light elements may used in the lighting system 114.

In operation, an area to be cleaned is selected. In the present embodiment, the area to be cleaned may comprise, for example, an article of clothing or furniture. The lighting system 114 may be activated and the cleaning system 100 applied to the selected area. When the lighting system 114 approaches the area to be cleaned, dust particles and other debris may be illuminated. In the present embodiment using an ultraviolet light, materials including phosphors tend to fluoresce in the visible spectrum and are thus easier to see.

The cleaner 112 is also applied to an area to be cleaned, such an article of clothing or upholstery. The cleaner 112 may then be moved across the surface, such as by rolling the lint roller 226 across the area to be cleaned. As the cleaning system 100 moves, the lighting system 114 illuminates the area to be cleaned, for example areas in the path of the lint roller 226. In the present embodiment, the lighting system 114 highlights debris to be removed by the cleaning system so that the operator may assess the areas to be cleaned, as well as the effectiveness of the cleaning as the cleaning proceeds. The process may be repeated until the operator is satisfied with the results.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The present invention has been described above with reference to an exemplary embodiment. However, changes and modifications may be made to the exemplary embodiment without departing from the scope of the present invention. These and other changes or modifications are intended to be included within the scope of the present invention.

The invention claimed is:

1. A cleaning apparatus, comprising:

a frame formed with a handle;

a cleaner including an exposed head having an exposed exterior with an adhesive characteristic and opposed first and second sides, the exposed head of the cleaner mounted to the frame opposing the handle;

a light coupled to the frame and positioned proximate to the first side of the exposed head of the cleaner to illuminate a surface to be cleaned along a cleaning path ahead of the light and the first side of the exposed head of the cleaner;

the handle of the frame available to be taken up to wield the frame to apply the exposed exterior of the exposed head of the cleaner across the surface to be cleaned along the cleaning path ahead of the light and the first side of the exposed head of the cleaner; and the surface to be cleaned along the cleaning path ahead of the light and the first side of the exposed head of the cleaner visible with respect to the exposed head of the cleaner, the light, and the frame formed with the handle.

2. The cleaning apparatus according to claim 1, further comprising a power supply and a switch formed in the frame, the switch operable to activate the power supply to power the light.

3. A cleaning apparatus, comprising:

a frame formed with a handle;

a cleaner including an exposed head having an exposed exterior with an adhesive characteristic and opposed first and second sides, the exposed head of the cleaner mounted to the frame opposing the handle;

a first light coupled to the frame proximate to the first side of the exposed head of the cleaner to illuminate a surface to be cleaned along and in a direction toward a first cleaning path ahead of the first light and the first side of the exposed head of the cleaner;

a second light coupled to the frame proximate to the second side of the exposed head of the cleaner to illuminate the surface to be cleaned along and in a direction toward a second cleaning path ahead of the second light and the second side of the exposed head of the cleaner;

the handle of the frame available to be taken up to wield the frame to apply the exposed exterior of the exposed head of the cleaner across the surface to be cleaned along the first cleaning path ahead of the first light and the first side of the exposed head of the cleaner, and along the second cleaning path ahead of the second light and the second side of the exposed head of the cleaner;

the surface to be cleaned along the first cleaning path ahead of the first light and the first side of the exposed head of the cleaner visible with respect to the exposed head of the cleaner, the first light, and the frame formed with the handle; and the surface to be cleaned along the second cleaning path ahead of the second light and the second side of the exposed head of the cleaner visible with respect to the exposed head of the cleaner, the second light, and the frame formed with the handle.

4. The cleaning apparatus according to claim 3, further comprising a power supply and a switch formed in the frame, the switch operable to activate the power supply to power the first light and the second light.

5. A cleaning apparatus, comprising:

an exposed lint head, the exposed lint head having an exposed lint-collecting exterior and opposed first and second sides, mounted to a frame formed with a handle;

a light coupled to the frame and positioned proximate to the first side of the exposed lint head to illuminate the surface to be cleaned along and in a direction toward a cleaning path ahead of the light and the first side of the exposed lint head;

the handle of the frame available to be taken up to wield the frame to apply the exposed lint-collecting exterior of the exposed lint head across the surface to be cleaned along the cleaning path ahead of the light and the first side of the exposed lint head; and the surface to be cleaned along the cleaning path ahead of the light and the first side of the exposed lint head visible with respect to the exposed lint head, the light, and the frame formed with the handle.

6. The cleaning apparatus according to claim 5, further comprising:

another light coupled to the frame proximate to the second side of the lint head to illuminate the surface to be cleaned along another cleaning path ahead of the other light and the second side of the lint head;

the other cleaning path is different from the cleaning path;

the handle of the frame available to be taken up to wield the frame to apply the lint head across the surface to be cleaned along the other cleaning path ahead of the other light and the second side of the lint head; and the surface to be cleaned along the other cleaning path ahead of the other light and the second side of the lint head visible with respect to the lint head, the other light, and the frame formed with the handle.

7. The cleaning apparatus according to claim 6, further comprising a power supply and a switch formed in the frame, the switch operable to activate the power supply to power the first light and the second light.

* * * * *